US011721210B2

(12) United States Patent
Kim

(10) Patent No.: US 11,721,210 B2
(45) Date of Patent: Aug. 8, 2023

(54) TRAFFIC LIGHT CONTROLLER AND METHOD OF CONTROLLING TRAFFIC LIGHT USING THE SAME

(71) Applicant: HYUNDAI MOBIS CO., LTD., Seoul (KR)

(72) Inventor: Seung Jae Kim, Yongin-si (KR)

(73) Assignee: HYUNDAI MOBIS CO., LTD., Seoul (KR)

( * ) Notice: Subject to any disclaimer, the term of this patent is extended or adjusted under 35 U.S.C. 154(b) by 252 days.

(21) Appl. No.: 17/226,725

(22) Filed: Apr. 9, 2021

(65) Prior Publication Data

US 2021/0319694 A1 Oct. 14, 2021

(30) Foreign Application Priority Data

Apr. 9, 2020 (KR) ..... 10-2020-0043646
Apr. 9, 2020 (KR) ..... 10-2020-0043647
Apr. 14, 2020 (KR) ..... 10-2020-0045583

(51) Int. Cl.

| | |
|---|---|
| ***G08G 1/087*** | (2006.01) |
| ***G08G 1/095*** | (2006.01) |
| ***G08G 1/01*** | (2006.01) |
| ***G08G 1/005*** | (2006.01) |

(52) U.S. Cl.
CPC ..... *G08G 1/087* (2013.01); *G08G 1/005* (2013.01); *G08G 1/0145* (2013.01); *G08G 1/095* (2013.01)

(58) Field of Classification Search
CPC ..... G08G 1/087; G08G 1/005; G08G 1/0145; G08G 1/095
See application file for complete search history.

(56) References Cited

U.S. PATENT DOCUMENTS

| | | | | |
|---|---|---|---|---|
| 11,562,647 | B2 * | 1/2023 | Nguyen | G08G 1/012 |
| 2009/0146841 | A1 * | 6/2009 | Basson | G08G 1/005 340/925 |

* cited by examiner

*Primary Examiner* — Omeed Alizada
(74) *Attorney, Agent, or Firm* — NovoTechIP International PLLC

(57) ABSTRACT

The present invention relates to a traffic light controller and a method of controlling a traffic light using the same. The traffic light controller according to the present invention includes an input unit configured to receive walking speed information of a pedestrian, a memory in which a program for controlling a traffic light using the walking speed information is stored, and a processor configured to execute the program, wherein the processor sets a lighting maintenance time of a green light of a pedestrian traffic light at a crosswalk using the walking speed information and changes the lighting maintenance time according to a result of monitoring a crossing situation.

18 Claims, 4 Drawing Sheets

TRAFFIC LIGHT CONTROLLER AND METHOD OF CONTROLLING TRAFFIC LIGHT USING THE SAME

CROSS-REFERENCE TO RELATED APPLICATION

This application claims priority to and the benefit of Korean Patent Application Nos. 10-2020-0043647, 10-2020-0043646, and 10-2020-0045583 filed in the Korean Intellectual Property Office on Apr. 9, 2020, Apr. 9, 2020, and Apr. 14, 2020, the entire contents of which are incorporated herein by reference.

BACKGROUND

1. Field of the Invention

The present invention relates to a traffic light controller and a method of controlling a traffic light using the same.

2. Discussion of Related Art

A pedestrian traffic light at a crosswalk is turned on based on seven seconds for a pedestrian to enter the crosswalk and one second per meter of a crossing distance.

In this case, when consideration for vulnerable pedestrians (children, the elderly, disabled, and the like) is necessary, a longer time of 1.5 seconds per one meter of a crossing distance is applied.

Among the number of traffic accident deaths, the number of deaths of elderly pedestrians is increasing.

Since elderly pedestrians have lowered physical abilities, a lowered sense of sight, and a lowered sense of hearing, there is a need to improve a traffic system in consideration of elderly pedestrians.

According to the related art, since a maintenance time of a green light of a pedestrian traffic light at a crosswalk is set based on a length of the crosswalk, there is a problem in that there is no consideration for vulnerable pedestrians.

That is, since the maintenance time of the green light of the pedestrian traffic light is fixed irrespective of a walking speed of the elderly, disabled, and children with a lowered walking ability, there is a problem in that crossing cannot be completed within the maintenance time of the green light of the pedestrian traffic light at the crosswalk.

In Singapore, technology is applied to increase a maintenance time of a green light of a pedestrian traffic light by giving a card to vulnerable pedestrians such as the elderly or disabled and touching the card to a card reader provided at a crosswalk.

However, in the technology, since the vulnerable pedestrian should directly hold and touch the card to the card reader to operate the pedestrian traffic light, there is inconvenience in use.

SUMMARY OF THE INVENTION

The present invention is directed to providing a traffic light controller which controls a lighting time of a pedestrian traffic light at a crosswalk based on a walking speed of a pedestrian, thereby securing safety of the pedestrian who crosses the crosswalk, and a method of controlling a traffic light using the same.

The present invention is also directed to providing a traffic light controller which more accurately acquires position information of a pedestrian, thereby securing safety of the pedestrian who crosses a crosswalk, and a method of controlling a traffic light using the same.

The present invention is also directed to providing a traffic light controller which controls a lighting time of a pedestrian traffic light at a crosswalk based on a walking speed of the pedestrian and prevents traffic flow obstruction due to a pedestrian who carelessly or intentionally delays a crossing time, and a method of controlling a traffic light using the same.

The present invention relates to a traffic light controller and a method of controlling a traffic light using the same.

The traffic light controller according to the present invention includes an input unit configured to receive walking speed information of a pedestrian, a memory in which a program for controlling a traffic light using the walking speed information is stored, and a processor configured to execute the program, wherein the processor sets a lighting maintenance time of a green light of a pedestrian traffic light at a crosswalk using the walking speed information and changes the lighting maintenance time according to a result of monitoring a crossing situation.

The input unit may receive average walking speed information according to walking history information of the pedestrian.

The input unit may receive current walking speed information of the pedestrian who crosses the crosswalk.

The processor may receive the current walking speed information of the pedestrian according to a pedestrian position search mode set based on a spacing distance between a vehicle and the pedestrian.

When the spacing distance is greater than or equal to a preset reference, the input unit may receive the current walking speed information calculated from position information of the pedestrian according to a time which is acquired using at least one of a camera, a radar, a LiDAR, and a global positioning system (GPS), and when the spacing distance is less than the preset reference, the input unit may receive the current walking speed information calculated from position information of the pedestrian according to a time which is acquired through ultra wideband (UWB) communication.

The processor may select a pedestrian whose crosswalk crossing time is delayed using the result of monitoring the crossing situation and may provide a warning to the pedestrian.

The processor may transmit information about the pedestrian to be warned to surrounding vehicles.

The processor may analyze information of pedestrians positioned in a surrounding area of the crosswalk, may determine a group of the pedestrians, who are subject to cross for a corresponding lighting time, and may set the lighting maintenance time in consideration of a minimum value among pieces of walking speed information of the pedestrians who are subject to cross.

The processor may determine a signal change time point of a vehicle traffic light according to the result of monitoring the crossing situation.

When a pedestrian to be warned is present, the processor may change the pedestrian traffic light to a red light and may also maintain the vehicle traffic light as a red light without increasing a preset lighting maintenance time of the green light of the pedestrian traffic light.

When it is determined that a pedestrian to be warned is present and a vehicle in a state of not recognizing signal information of the vehicle traffic light is present, the processor may extend a preset lighting maintenance time of the green light of the pedestrian traffic light.

The method of controlling a traffic signal according to the present invention includes operation (a) of acquiring walking speed information of a pedestrian, operation (b) of setting a lighting maintenance time of a green light of a pedestrian traffic light at a crosswalk using the walking speed information, operation (c) of monitoring a crossing situation, and operation (d) of changing the lighting maintenance time of the green light of the pedestrian traffic light according to a result of the monitoring.

In operation (a), average walking speed information according to walking history information of the pedestrian may be acquired.

In operation (b), the lighting maintenance time may be set by analyzing information about pedestrians positioned in a surrounding area of the crosswalk and determining a group of the pedestrians who are subject to cross in a corresponding lighting turn.

In operation (c), the crossing situation may be monitored using at least one of current walking speed information and a walking trajectory of the pedestrian who crosses the crosswalk.

In operation (d), a pedestrian to be warned may be selected according to the result of the monitoring, a warning may be provided to the pedestrian, and the lighting maintenance time may be changed in consideration of the pedestrian to be warned.

The method may further include operation (e) of transmitting information about the pedestrian to be warned to surrounding vehicles.

The method may further include operation (f) of determining a signal change time point of a vehicle traffic light according to the result of the monitoring.

In operation (f), when a pedestrian to be warned is present, the pedestrian traffic light may be changed to a red light, and the vehicle traffic light may be maintained as a red light without extending a preset lighting maintenance time of the green light of the pedestrian traffic light.

In operation (f), when it is determined that a pedestrian to be warned is present and a vehicle in a state of not recognizing signal information of the vehicle traffic light is present, a preset lighting maintenance time of the green light of the pedestrian traffic light may be extended.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which.

DETAILED DESCRIPTION OF EXEMPLARY EMBODIMENTS

The advantages and features of the present invention and methods for accomplishing the same will be more clearly understood from embodiments to be described in detail below with reference to the accompanying drawings.

However, the present invention is not limited to the following embodiments but may be implemented in various different forms. Rather, these embodiments are provided only to complete the disclosure of the present invention and to allow those skilled in the art to understand the category of the present invention. The present invention is defined by the category of the claims.

Meanwhile, terms used in this specification are to describe the embodiments and are not intended to limit the present invention. As used herein, singular expressions, unless defined otherwise in context, include plural expressions. It will be further understood that the terms "comprises," "comprising," "includes," and/or "including," when used herein, specify the presence of stated components, steps, operations, and/or elements, but do not preclude the presence or addition of one or more other components, steps, operations, and/or elements.

Figure 1:
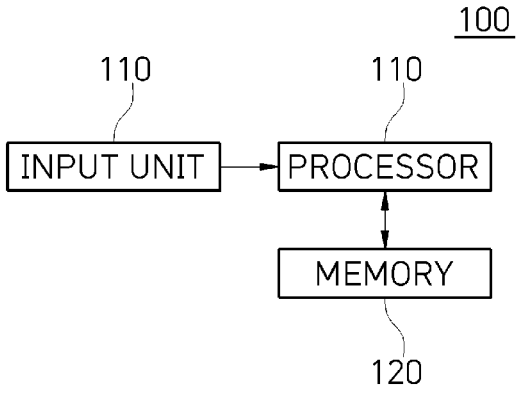
FIG. 1 illustrates a configuration of a traffic light controller according to an embodiment of the present invention.

FIG. 1 illustrates a configuration of a traffic light controller according to an embodiment of the present invention.

The traffic light controller according to the embodiment of the present invention includes an input unit 110 configured to receive walking speed information of a pedestrian, a memory 120 in which a program for controlling a traffic light using the walking speed information is stored, and a processor 130 configured to execute the program. The processor 130 sets a maintenance time of a green light of a pedestrian traffic light at a crosswalk using the walking speed information and changes the maintenance time according to a result of monitoring a crossing situation.

The input unit 110 receives average walking speed information according to walking history information of the pedestrian.

The input unit 110 receives current walking speed information of the pedestrian who crosses the crosswalk.

The processor 130 receives the current walking speed information of the pedestrian according to a pedestrian position search mode set based on a spacing distance between a vehicle and the pedestrian.

When the spacing distance is greater than or equal to a preset reference, the input unit 110 receives the current walking speed information calculated from position information of the pedestrian according to a time which is acquired using at least one of a camera, a radar, a LiDAR, and a global positioning system (GPS). When the spacing distance is less than the preset reference, the input unit 110 receives the current walking speed information calculated from position information of the pedestrian according to a time which is acquired through ultra wideband (UWB) communication.

The processor 130 selects a pedestrian whose crosswalk crossing time is delayed by using the result of monitoring the crossing situation and provides a warning to the corresponding pedestrian.

The processor 130 transmits information about the pedestrian to be warned to surrounding vehicles.

The processor 130 analyzes information about pedestrians positioned in a surrounding area of the crosswalk, determines a group of pedestrians who are subject to cross for a corresponding lighting time, and sets a maintenance time in consideration of a minimum value among pieces of walking speed information of the pedestrians who are subject to crossing.

The processor 130 determines a signal change time point of a vehicle traffic light according to the result of monitoring the crossing situation.

When a pedestrian to be warned is present, the processor 130 changes the pedestrian traffic light to a red light and also maintains the vehicle traffic light as a red light without increasing a preset lighting maintenance time of the green light of the pedestrian traffic light.

When it is determined that a pedestrian to be warned is present and a vehicle in a state of not recognizing signal information of the vehicle traffic light is present, the processor 130 extends the preset lighting maintenance time of the green light of the pedestrian traffic light.

Figure 2:
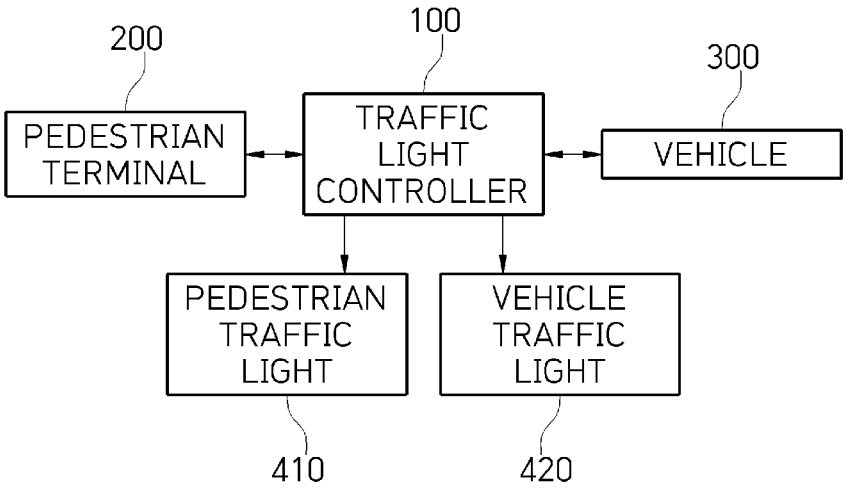
FIG. 2 illustrates a traffic light control system according to an embodiment of the present invention.
Figure 3:
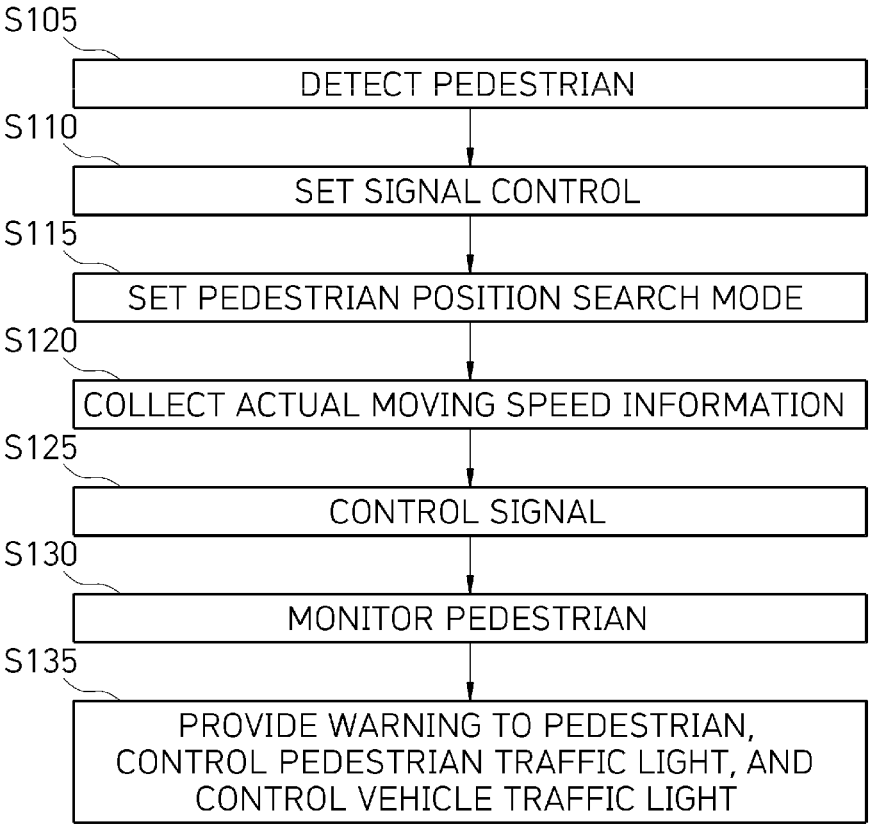
FIGS. 3 and 4 illustrate a flowchart of a method of controlling a traffic light according to an embodiment of the present invention.
Figure 4:
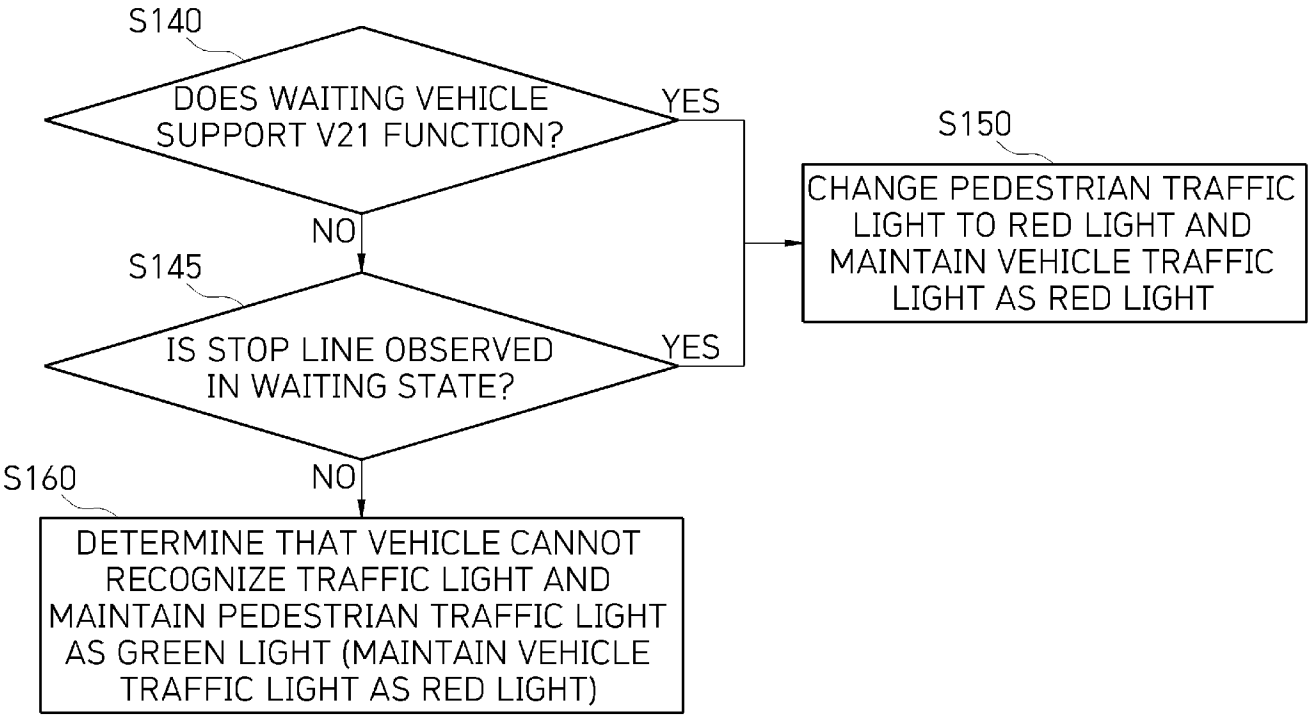

FIG. 2 illustrates a traffic light control system according to an embodiment of the present invention, and FIGS. 3 and 4 illustrate a flowchart of a method of controlling a traffic light according to an embodiment of the present invention.

A pedestrian terminal 200 acquires walking speed information of a pedestrian and transmits average walking speed information to a traffic light controller 100 (S105).

The pedestrian terminal 200 is a smart phone or a wearable device having a communication function and shares the walking speed information through a service application.

In this case, the pedestrian terminal 200 transmits average walking speed information of pieces of walking speed information within a preset period range (for example, 48 hours) from a current time point to the traffic light controller 100 to share latest walking history information with the traffic light controller 100.

The traffic light controller 100 sets a lighting maintenance time of a green light of a pedestrian traffic light 410 and sets the corresponding time using the average walking speed information received from the pedestrian terminal 200 (S110).

In this case, the lighting maintenance time of the green light is set by adding a time allowance to a value obtained by dividing a length of a crosswalk by the average walking speed information.

That is, the traffic light controller 100 controls the pedestrian traffic light 410 in consideration of average walking speed information of pedestrians and length information of a crosswalk.

For example, it is assumed that the lighting maintenance time of the green light of the pedestrian traffic light 410 at a specific crosswalk is set to 30 seconds.

As a result of the consideration of the average walking speed information, when a pedestrian who takes 45 seconds to cross a corresponding crosswalk is present, the traffic light controller 100 sets the lighting maintenance time of the green light of the pedestrian traffic light 410 at the corresponding crosswalk to 50 seconds including a time allowance, thereby allowing the pedestrian to safely cross the crosswalk.

The traffic light controller 100 transmits information about the lighting maintenance time of the green light and information about the remaining lighting maintenance time to a vehicle 300 waiting for a light to change near the crosswalk.

In this case, the traffic light controller 100 receives position information from the pedestrian terminal 200, photographs a surrounding area of the crosswalk using a camera, or receives information about a pedestrian from the vehicle 300 around the crosswalk.

The traffic light controller 100 analyzes information about pedestrians positioned in the surrounding area of the crosswalk and determines a group of pedestrians who are subject to crossing when the green light of the pedestrian traffic light is turned on at the present time.

The traffic light controller 100 collects pieces of average walking speed information of the pedestrians belonging to the group of the pedestrians and sets the light maintenance time of the green light of the pedestrian traffic light 410 in consideration of average walking speed information of a specific pedestrian corresponding to a minimum value among the pieces of average walking speed information.

For example, when three pedestrians at the crosswalk are the pedestrians who are subject to cross, one of the pedestrians is an elderly person, and as a result of consideration of average walking speed information of the elderly person, when it is expected that the elderly person takes 50 seconds to cross the crosswalk, the traffic light controller 100 sets the lighting maintenance time of the green light to 60 seconds including a time allowance.

The traffic light controller 100 sets the lighting maintenance time of the green light of the pedestrian traffic light 410 using average walking speed information of pedestrians and determines whether the lighting maintenance time of the green light needs to be changed using current walking speed information of pedestrians who are actually crossing.

In this case, the traffic light controller 100 receives current walking speed information acquired using a sensor of the waiting vehicle 300 or receives the current walking speed information acquired using a camera disposed at an intersection (S120) and determines whether the lighting maintenance time of the green light needs to be changed in consideration of complexity of the crosswalk through pedestrian detection (S125).

As a result of comparing the average walking speed information and the current walking speed information, when a difference between the average walking speed information and the current walking speed information is within a preset reference, the preset lighting maintenance time of the green light of the pedestrian traffic light 410 is maintained.

However, in a situation in which the number of waiting pedestrians to cross the crosswalk is very great, or when a vehicle that stops at the crosswalk beyond a stop line is present, a crossing speed of the pedestrians will be decreased.

In this case, considering the above-described average walking speed information, even in a situation in which 30 seconds is expected to be sufficient for all pedestrians to cross the crosswalk, actually, it is determined that the time is sufficient only when the preset lighting maintenance time of the green light of the pedestrian traffic light 410 is at least 50 seconds for safe crossing according to the complexity of the crosswalk.

In this case, the traffic light controller 100 uses the current walking speed information to change the lighting maintenance time of the green light of the pedestrian traffic light 410 from 30 seconds to 50 seconds and transmits information about a change in the lighting maintenance time of the green light, information about the remaining lighting time, and the like to the vehicle 300.

In addition, the traffic light controller 100 controls the vehicle traffic light 420 according to the change in the lighting maintenance time of the green light of the pedestrian traffic light 410.

The above-described example relates to a situation in which a pedestrian has to cross slower than his or her walking ability, but there is a case in which a crossing speed is decreased due to careless actions of a pedestrian who crosses a crosswalk, such as walking while viewing a smartphone.

Alternatively, there may be a case in which a pedestrian intentionally crosses slowly to obstruct traffic.

The traffic light controller 100 selects a pedestrian who carelessly or intentionally delays a crosswalk crossing time in comprehensive consideration of the average walking speed information, the complexity of the crosswalk, and the current walking speed information (S130). Hereinafter, the corresponding pedestrian will be defined as a pedestrian to be warned.

The traffic light controller 100 provides a warning message to the corresponding pedestrian to be warned through a sound alarm or the like or transmits a warning to the terminal 200 of the pedestrian to be warned and transmits information about the pedestrian to be warned to the vehicle 300 (S315).

The vehicle 300 receiving the information about the pedestrian to be warned may provide a warning to the pedestrian to be warned through a headlight or klaxon and may perform autonomous driving to prevent a collision with the pedestrian in consideration of the information about the pedestrian to be warned or provide a collision avoidance warning to a driver.

In addition, when a pedestrian crosses, the traffic light controller 100 acquires movement trajectory information using the pedestrian terminal 200, the vehicle 300, and a camera disposed at the crosswalk, and accordingly, when the pedestrian needs to be selected as the pedestrian to be warned, as described above, the traffic light controller 100 selects the pedestrian to be warned, provides a warning, and shares information.

In order to acquire more accurate crossing information of a pedestrian, UWB technology is used.

In order to provide a local-based service (LSB), technologies such as a GPS, Wi-Fi, and Bluetooth are used. The technologies have a problem in that it is difficult to perform accurate measurement, but UWB technology has an advantage in that positioning is possible at a high accuracy of about several dozens of centimeters in a wide frequency band from 3.1 GHz to 10.6 GHz through low power communication.

GPS-based and mobile communication network-based position tracking technologies according to the related art have an error range of 5 m to 50 m and an error range of 50 m to 200 m, respectively, and in the case of a GPS, the arrival of signals transmitted from satellites may be interrupted in an urban building forest.

In the case of Wi-Fi, position tracking is possible at low cost, but since a used frequency band is narrow, when the number of subject to be position-tracked is increased, there may be a limitation in channel division. In addition, a mobile terminal may be disconnected from a fixed Wi-Fi access point (AP).

In the case of Bluetooth, although a plurality of sensors may be disposed at low cost, Bluetooth is not suitable for real time position tracking in a dynamic environment due to high communication latency thereof.

Unlike Wi-Fi and Bluetooth, in the case of a UWB, a wide frequency band is used, and it is possible to transmit a large amount of information through a high transmission rate with low power.

Positioning using UWB technology has advantages of having a low error rate of about 20 cm, having high transmittance with respect to obstacles, and not being affected by other signals of Wi-Fi or the like.

As methods of measuring a position through a signal transmitted from a transmitter (anchor) fixed at a specific position, there are two representative methods such as a time-of-arrival (ToA) method and an angle-of-arrival (AoA) method.

The ToA method is a method in which a receiver (tag) calculates distances to a plurality of anchors through signals transmitted from the plurality of anchors and measures a current position of the tag through the calculated distances.

The AoA method is a method in which angles between a tag and a plurality of anchors are obtained through signals transmitted from the anchors and a current position of the tag is measured through the angles with the plurality of anchors.

The traffic light controller 100 or the vehicle 300 acquires information about an exact position of the pedestrian terminal 200 through UWB communication with the pedestrian terminal 200.

In the following detailed description, an example will be described in which the vehicle 300 and the pedestrian terminal 200 perform UWB communication.

The vehicle 300 sets a pedestrian position search mode based on a distance to the pedestrian (S115).

On the basis of a preset distance (for example, 10 meters), a pedestrian detection main sensor of the vehicle 300 detects a position, a trajectory, and a moving speed of a pedestrian through a camera, a LiDAR, a radar, and a GPS with respect to the pedestrian terminal 200 at a distance that is greater or equal to 10 meters.

The pedestrian detection main sensor of the vehicle 300 detects a position, a trajectory, and a moving speed of a pedestrian using UWB communication with respect to the pedestrian terminal 200 within a distance that is less than 10 meters.

The traffic light controller 100 receives position information and current walking speed information of a pedestrian from the vehicle 300, checks whether the pedestrian is crossing according to a walking ability based on the received position information and current walking speed information, and determines whether the lighting maintenance time of the green light of the pedestrian traffic light 410 needs to be changed.

When the lighting maintenance time of the green light of the pedestrian traffic light 410 is controlled in consideration of a speed of a pedestrian, a warning may be provided to a pedestrian who carelessly or intentionally crosses slowly, but in this case, the lighting maintenance time of the green light may be increased, which hinders an overall flow of traffic.

Therefore, the traffic light controller 100 controls the lighting maintenance time of the green light of the pedestrian traffic light 410 in consideration of a walking speed of a pedestrian. When a pedestrian who carelessly or intentionally crosses slowly is present, the traffic light controller 100 changes the pedestrian traffic light 410 to a "red light" when the preset lighting maintenance time has elapsed without increasing the lighting maintenance time of the green light of the pedestrian traffic light 410.

In this case, a warning message about the change of the pedestrian traffic light 410 to the "red light" may be provided directly to a pedestrian through a sound or the like as described above, or a warning message may be transmitted to the pedestrian terminal 200 to provide notification of the change of the pedestrian traffic light 410 through a sound or vibration.

However, when the vehicle 300 stops beyond a stop line, a driver or an autonomous vehicle cannot recognize a vehicle traffic light.

In this case, when the pedestrian traffic light 410 is changed to the red light, a driver of a vehicle starts the vehicle by predicting that the vehicle traffic light 420 has changed to the green light. Thus, the vehicle may collide with a pedestrian who has not yet completed the crossing.

Therefore, when it is determined that a waiting vehicle cannot recognize the vehicle traffic light (for example, when the waiting vehicle stops beyond a stop line, a driver of the waiting vehicle cannot visually recognize the vehicle traffic light and can recognize only the pedestrian traffic light), the traffic light controller 100 does not perform a process of changing the pedestrian traffic light 410 to the "red light" as described above and maintains turning-on of the green light of the pedestrian traffic light 410 and also maintains the vehicle traffic light 420 as a "red light" until the crossing is completed.

The traffic light controller 100 checks whether the vehicle 300 supports a vehicle-to-infrastructure (V2I) function (S140). When the vehicle 300 has the V2I function, the traffic light controller 100 changes the pedestrian traffic light 410 to the "red light," maintains the vehicle traffic light 420 as the "red light" (S150), and notifies the vehicle 300 that the vehicle traffic light 420 is maintained as the "red light" through the V2I function.

When the waiting vehicle 300 does not support the V2I function, whether the vehicle 300 has crossed a stop line is checked (S145). When the vehicle 300 does not support the V2I function and it is checked that the stop line has been crossed, it is determined that the vehicle 300 cannot recognize the vehicle traffic light. In order to prevent a driver from starting the vehicle 300 by predicting that the vehicle traffic light 420 has changed from the change of the pedestrian traffic light 410 described above, the pedestrian traffic light 410 is maintained as the green light, and the vehicle traffic light 420 is maintained as the red light (S160).

According to embodiments of the present invention, a lighting maintenance time of a green light of a pedestrian traffic light is adjusted in consideration of a walking speed, thereby allowing vulnerable pedestrians with a slow walking speed to safely cross a crosswalk.

The present invention can be linked to an increase in sales of the sensor industry for measuring a moving speed of a pedestrian and can be reflected in designs of traffic facilities, thereby being used to build a smart city in which pedestrians can walk with an easy conscience.

Through UWB communication, a position of a pedestrian is more accurately recognized, and a safe crossing of the pedestrian is supported.

Among pedestrians who cross a crosswalk, a pedestrian who carelessly crosses or intentionally delays a crossing time is selected to be provided with a warning, thereby promoting a smooth flow of traffic.

According to a result of monitoring a pedestrian who carelessly crosses or intentionally delays a crossing time among pedestrians who cross a crosswalk, a lighting time of a green light of a pedestrian traffic light at the crosswalk is not extended meaninglessly, thereby not only allowing pedestrians to safely complete the crossing but also promoting a smooth flow of traffic.

The effects of the present invention are not limited to the aforesaid, but other effects not described herein will be clearly understood by those skilled in the art from descriptions below.

Meanwhile, the method of controlling a traffic light according to the embodiment of the present invention may be implemented in a computer system or recorded in a recording medium. The computer system may include at least one processor, a memory, a user input device, a data communication bus, a user output device, and a storage. Each of the above-described components performs data communication through the data communication bus.

The computer system may further include a network interface coupled to a network. The processor may be a central processing unit (CPU) or a semiconductor device for processing a command stored in the memory and/or the storage.

The memory and the storage may include various types of volatile or nonvolatile storage media. For example, the memory may include a read-only memory (ROM) and a random-access memory (RAM).

Therefore, the method of controlling a traffic light according to the embodiment of the present invention may be implemented as a computer-executable method. When the method of controlling a traffic light according to the embodiment of the present invention is executed in a computer device, computer-readable commands may perform the method of controlling a traffic light according to the present invention.

Meanwhile, the above-described method of controlling a traffic light according to the present invention may also be embodied as computer-readable codes on a computer-readable recording medium. The computer-readable recording medium includes any type of recording media in which data that can be read by a computer system is stored. Examples of the computer-readable recording media include a ROM, a RAM, a magnetic tape, a magnetic disc, a flash memory, an optical data storage device, and the like. In addition, the computer-readable recording medium may also be distributed over network coupled computer systems so that the computer-readable code may be stored and executed in a distributed fashion.

So far, the present invention has been described with reference to embodiments thereof. It should be understood by those skilled in the art that various changes in form and details may be made therein without departing from the spirit and scope of the present invention. Therefore, the disclosed embodiments should be considered in a descriptive sense only and not for purposes of limitation. Also, the scope of the present invention is defined not by the detailed description of embodiments but by the appended claims, and all differences within the scope thereof should be construed as being included in the present invention.

What is claimed is:

1. A method of controlling a pedestrian traffic signal positioned at a crosswalk, the method comprising:

acquiring pedestrian walking speed data indicating a walking speed a pedestrian;

setting, based on the acquired pedestrian walking speed data, a duration for displaying a green light at the pedestrian traffic light;

monitoring a crossing situation of the pedestrian at the crosswalk;

changing, based on the monitored crossing situation at the crosswalk, the duration for displaying the green light at the pedestrian traffic light;

determining, based on the monitored crossing situation at the crosswalk, a time for changing the vehicle traffic light; and in response to detecting (1) a presence of a problematic pedestrian causing the duration for displaying the green light to be increased and (2) a presence of a vehicle not recognizing the vehicle traffic light, extending the duration for displaying the green light at the pedestrian traffic light.

2. The method of claim 1, wherein the pedestrian walking speed data indicates an average walking speed of the pedestrian determined based on walking history data of the pedestrian.

3. The method of claim 1, wherein:

the pedestrian comprises a plurality of pedestrians in a surrounding area of the crosswalk, and setting the green light display time comprises:

analyzing a position of each of the pedestrians; and determining a group of the pedestrians expected to cross the crosswalk when a green light is displayed at the pedestrian traffic light.

4. The method of claim 1, wherein monitoring the crossing situation comprises monitoring at least one of a current walking speed and a walking trajectory of the pedestrian crossing the crosswalk.

5. The method of claim 1, further comprising:

identifying, based on the monitored crossing situation, the problematic pedestrian; and outputting a warning to the problematic pedestrian.

6. The method of claim 5, further comprising transmitting, to one or more vehicles in a surrounding area of the crosswalk, information about the problematic pedestrian.

7. The method of claim 1, further comprising, in response to detecting the presence of the problematic pedestrian, changing the pedestrian traffic light to red, and maintaining the vehicle traffic light as red without extending the duration for displaying the green light at the pedestrian traffic light.

8. A system for controlling a pedestrian traffic signal near a crosswalk, the controller comprising:

a processor; and a non-transitory computer-readable medium in communication with the processor and storing instructions that, when executed by the processor, cause the system to control the traffic light controller to perform:

acquiring pedestrian walking speed data indicating a walking speed of a pedestrian;

setting, based on the acquired pedestrian walking speed data, a duration for displaying a green light at the pedestrian traffic signal;

monitoring a crossing situation of the pedestrian at the crosswalk;

changing, based on the monitored crossing situation at the crosswalk, the duration for displaying the green light at the pedestrian traffic light; and determining, based on the monitored crossing situation, a time for changing a vehicle traffic light; and in response to detecting (1) a presence of a problematic pedestrian causing the duration for displaying the green light to be increased and (2) a presence of a vehicle not recognizing the vehicle traffic light, extending the duration for displaying the green light at the pedestrian traffic light.

9. The system of claim 8, wherein the pedestrian walking speed data indicates an average walking speed of the pedestrian acquired based on walking history data of the pedestrian.

10. The system of claim 8, wherein the pedestrian walking speed data indicates a current walking speed of the pedestrian crossing the crosstalk.

11. The system of claim 10, wherein, for acquiring the pedestrian walking speed data, the instructions, when executed by the processor, further cause the processor to control the system to perform setting, based on a distance between a vehicle and the pedestrian, the system to operate in a pedestrian position search mode.

12. The system of claim 11, wherein, for acquiring the pedestrian walking speed data, the instructions, when executed by the processor, further cause the processor to control the system to perform:

in response to the distance between the vehicle and the pedestrian being equal to or greater than a preset distance, receiving a first current walking speed of the pedestrian calculated from first position information of the pedestrian acquired using at least one of a camera, a radar, a LiDAR, and a global positioning system (GPS); and in response to the distance between the vehicle and the pedestrian being less than the preset distance, receiving a second current walking speed of the pedestrian calculated from second position information of the pedestrian acquired through a ultrawideband (UWB) communication.

13. The system of claim 8, wherein the instructions, when executed by the processor, further cause the processor to control the system to perform:

determining, based on the monitored crossing situation of the pedestrian, whether the pedestrian is a problematic pedestrian causing a crosswalk crossing time to be increased; and in response to determining that the pedestrian is the problematic pedestrian, outputting a warning to the pedestrian.

14. The system of claim 13, wherein the instructions, when executed by the processor, further cause the processor to control the system to perform transmitting, to one or more vehicles near the crosswalk, a warning about the problematic pedestrian.

15. The system of claim 8, wherein, for setting the duration for displaying the green light at the pedestrian traffic signal, the instructions, when executed by the processor, further cause the processor to control the system to perform:

analyzing information of one or more pedestrians near the crosswalk;

determining a group of the pedestrians expected to cross the crosswalk; and setting the duration for displaying the green light based on a minimum value among a plurality of walking speeds of the pedestrians expected to cross the crosswalk.

16. The system of claim 8, wherein the instructions, when executed by the processor, further cause the processor to control the system to perform determining, based on the monitored crossing situation, a time to change a light displayed at a vehicle traffic light near the crosswalk.

17. The system of claim 16, wherein the instructions, when executed by the processor, further cause the processor to control the system to perform:

determining that the pedestrian is a problematic pedestrian causing the duration to display the green light at the pedestrian traffic light to be increased;

changing the pedestrian traffic light to a red light; and causing the vehicle traffic light to continue displaying a red light without increasing a preset duration for displaying the green light at the pedestrian traffic signal.

18. The system of claim 16, wherein the instructions, when executed by the processor, further cause the processor to control the system to perform in response to detecting (1) a presence of a problematic pedestrian causing the duration for displaying the green light to be increased and (2) a presence of a vehicle not recognizing the vehicle traffic light, extending the duration for displaying the green light at the pedestrian traffic light.

* * * * *